US010695797B2

(12) United States Patent
Andreae et al.

(10) Patent No.: US 10,695,797 B2
(45) Date of Patent: Jun. 30, 2020

(54) SYSTEM AND METHOD OF COATING PRODUCTS

(71) Applicant: SST Systems, Inc., Sturgeon Bay, WI (US)

(72) Inventors: Chad Martin Andreae, Sturgeon Bay, WI (US); Robert G. Rock, Sturgeon Bay, WI (US); Bradley S. Andreae, Sturgeon Bay, WI (US); Daniel M. Reichel, Sturgeon Bay, WI (US)

(73) Assignee: SST Systems, Inc., Sturgeon Bay, WI (US)

( * ) Notice: Subject to any disclaimer, the term of this patent is extended or adjusted under 35 U.S.C. 154(b) by 374 days.

(21) Appl. No.: 15/418,756

(22) Filed: Jan. 29, 2017

(65) Prior Publication Data

US 2017/0216879 A1 Aug. 3, 2017

Related U.S. Application Data

(60) Provisional application No. 62/289,152, filed on Jan. 29, 2016.

(51) Int. Cl.

| | |
|---|---|
| ***B05D 7/22*** | (2006.01) |
| ***C25D 13/14*** | (2006.01) |
| ***C25D 1/00*** | (2006.01) |
| ***C25D 13/22*** | (2006.01) |
| *B05D 1/12* | (2006.01) |

(52) U.S. Cl.

CPC ..... *B05D 7/222* (2013.01); *C25D 1/00* (2013.01); *C25D 13/14* (2013.01); *C25D 13/22* (2013.01); *B05D 1/12* (2013.01)

(58) Field of Classification Search

CPC . B05D 7/222; B05D 1/12; B05D 1/02; B05D 2254/04; B05D 1/40; B05D 1/28; B05D 3/12; B05D 3/10; B05D 5/005; B05D 3/0218; B05D 1/06; B05D 2202/00; C25D 1/00; C25D 13/14; C25D 13/22; C25D 13/12; B05C 11/021; B05C 7/08; F16L 55/1645; F16L 58/1009; B05B 1/265; B05B 7/10; B05B 7/1472; B05B 7/1486; B05B 13/0627; B05B 12/1472; B05B 1/28; B05B 7/0815; B05B 5/032; B05B 5/047;

(Continued)

(56) References Cited

U.S. PATENT DOCUMENTS 3,849,284 A * 11/1974 Kossmann ..... B65G 49/0413 204/625
3,922,213 A * 11/1975 Smith ..... C25D 13/14 204/479
4,107,016 A * 8/1978 Brower, Jr. ..... C25D 13/14 204/479

* cited by examiner

*Primary Examiner* — Xiuyu Tai
(74) *Attorney, Agent, or Firm* — Michael Best & Friedrich LLP

(57) ABSTRACT

Systems and methods are provided for coating interior surfaces of products with coating material. The systems and methods can include at least one plug to selectively close an opening of the product, wherein the plug is movable relative to the opening between a first position in which the plug is retracted from the opening and a second position in which the plug is engaged with the opening to seal the opening. When the plug is in the second position, a pump delivers coating material to the cavity of the product via a fluid line and a port in the plug. The coating material can fill the cavity, and an electrode can be energized to coat the interior surface of the product with an electrophoretic deposition process. Other coating processes can also be used in a similar manner.

21 Claims, 8 Drawing Sheets

(58) Field of Classification Search
CPC ..... B05B 5/12; B05B 5/1683; B05B 5/001;
C23C 4/16
See application file for complete search history.

SYSTEM AND METHOD OF COATING PRODUCTS

CROSS-REFERENCE TO RELATED APPLICATIONS

Priority is hereby claimed to U.S. provisional patent application No. 62/289,152 filed on Jan. 29, 2016, the entire contents of which are incorporated herein by reference.

BACKGROUND

Embodiments of the invention relate to coating systems and methods, and methods of coating the inside of pipes and other products having interior surfaces.

Electrophoretic deposition (or EPD) is a method of applying a material, such as paint, to an electrically conductive surface. For example, EPD has been widely used to coat automobile bodies and parts, tractors and heavy equipment, electrical switch gear, appliances, metal furniture, beverage containers, fasteners, and many other industrial products. Some forms of electrophoretic deposition include electrocoating, e-coating, cathodic electrodeposition, anodic electrodeposition, aqueous electrophoretic deposition, and electrophoretic coating, or electrophoretic painting.

The EPD process involves preparing the product for coating, coating the product with the main coating, and the curing the coating on the product. During the preparation stage, the product is typically cleaned and coated with a pre-coat, such as an inorganic phosphate coating, silane coating, zirconium, or any other conversion coating. When applying the main coat, the product is submerged in a reservoir filled with a solution of polymers that often includes of a mixture of the coating and water. The coating is applied by directing an electrical current through the reservoir using electrodes. The product being coated is considered one of the electrodes, and a set of "counter-electrodes" is used to complete the circuit. Typical voltages can be anywhere from 25-400 volts of direct current. Depending at least in part on the material of the product being coated, higher and lower voltages are possible.

When the voltage is applied to the system, the molecules in the coating attach to the surface of the product, which acts as one of the electrodes. More specifically, the polymer molecules carrying a certain charge will attach to the product, which carries the opposite charge as the polymers. For example, if an anodic EPD process is used, the polymers will carry a negative charge, and will be deposited on a positively charged product. In this case, the counter-electrodes act as cathodes and the product acts as the anode. On the other hand, if a cathodic EPD process is used, the polymers will carry a positive charge, and will be deposited on a negatively charged product. In this case, the counter-electrodes act as anodes, and the product acts as the cathode.

After the coating is applied to the product, excess solution is then rinsed off of the product. Finally, the coating is fixed, or cured, to the product.

EPD processes have a number of advantages that make the process appealing. For example, the applied coatings generally have a very uniform thickness. Objects with complex shapes can be easily coated. The process is fairly high speed and can apply to a wide range of materials, such as metals, ceramics, and polymers. One limitation of EPD is that it is difficult to use to use EPD to coat the inside of products having interior surfaces, such as pipes, and other products having internal cavities where the electric current cannot travel easily. Accordingly, many product manufacturers coat the inside of products with materials that are less than optimal primarily because EPD and other product coating processes are not available. By way of example, many large pipe manufacturers coat the inside surfaces of the pipes with asphalt using an alternative method, rather than EPD.

SUMMARY

Some embodiments of the present disclosure provide a product coating system for coating a product with a coating material, wherein the product includes an exterior surface, a cavity defined by an interior surface, and an opening extending between the exterior surface and the interior surface, and wherein the product coating system comprises a plug sized and shaped to selectively close the opening, the plug movable relative to the opening between a first position in which the plug is retracted from the opening, and a second position in which the plug is engaged with the opening to close the opening; a port defined in the plug and through which the coating material passes to enter the cavity; a pump; and a fluid line establishing fluid communication between the pump and the port; the system having a first configuration in which the plug is in the first position and coating material delivery to the cavity is stopped, and a second configuration in which the plug is in the second position and in which the pump delivers coating material to the cavity of the product via the fluid line and port.

In some embodiments, a method of coating a product with coating material is provided, wherein the product includes an exterior surface, a cavity defined by an interior surface, and an opening extending between the exterior surface and the interior surface, and wherein the method comprises moving a plug from a first position disengaged with respect to the opening to a second position in which the plug is engaged with the opening of the product; closing the opening of the product by moving the plug to the second position; pumping coating material through the plug and into the cavity while the plug is in the second position; coating the interior surface of the product with the coating material pumped into the cavity while the plug is in the second position; and draining excess coating material from the cavity.

Some embodiments of the present disclosure provide a product coating system for coating an interior surface of a cavity of a product with a coating liquid, wherein the product includes an exterior surface, a first opening extending between the exterior surface and the interior surface, and a second opening extending between the exterior surface and the interior surface, and wherein the product coating system comprises first and second plugs sized and shaped to selectively seal the first and second openings, respectively, each of the first and second plugs movable relative to the respective first and second openings between respective first positions in which the first and second plugs are retracted from the first and second openings, and respective second positions in which the first and second plugs seal the first and second openings; a pump; a first fluid line extending between the pump and the first plug for directing coating liquid from the pump toward the first plug; a second fluid line extending between the pump and the second plug for directing coating liquid from the second plug back to the pump; and an electrode removably insertable into the cavity of the product to a position in which the electrode is inside the cavity and out of contact with the interior surface of the cavity while the first and second plugs are in the respective second positions; wherein coating liquid pumped to the first plug enters the cavity through the first plug and fills the cavity; and wherein coating liquid is drained from the cavity through the second plug and into the second fluid line.

Other aspects of the invention will become apparent by consideration of the detailed description and accompanying drawings.

DETAILED DESCRIPTION

Before embodiments are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items.

Figure 1:
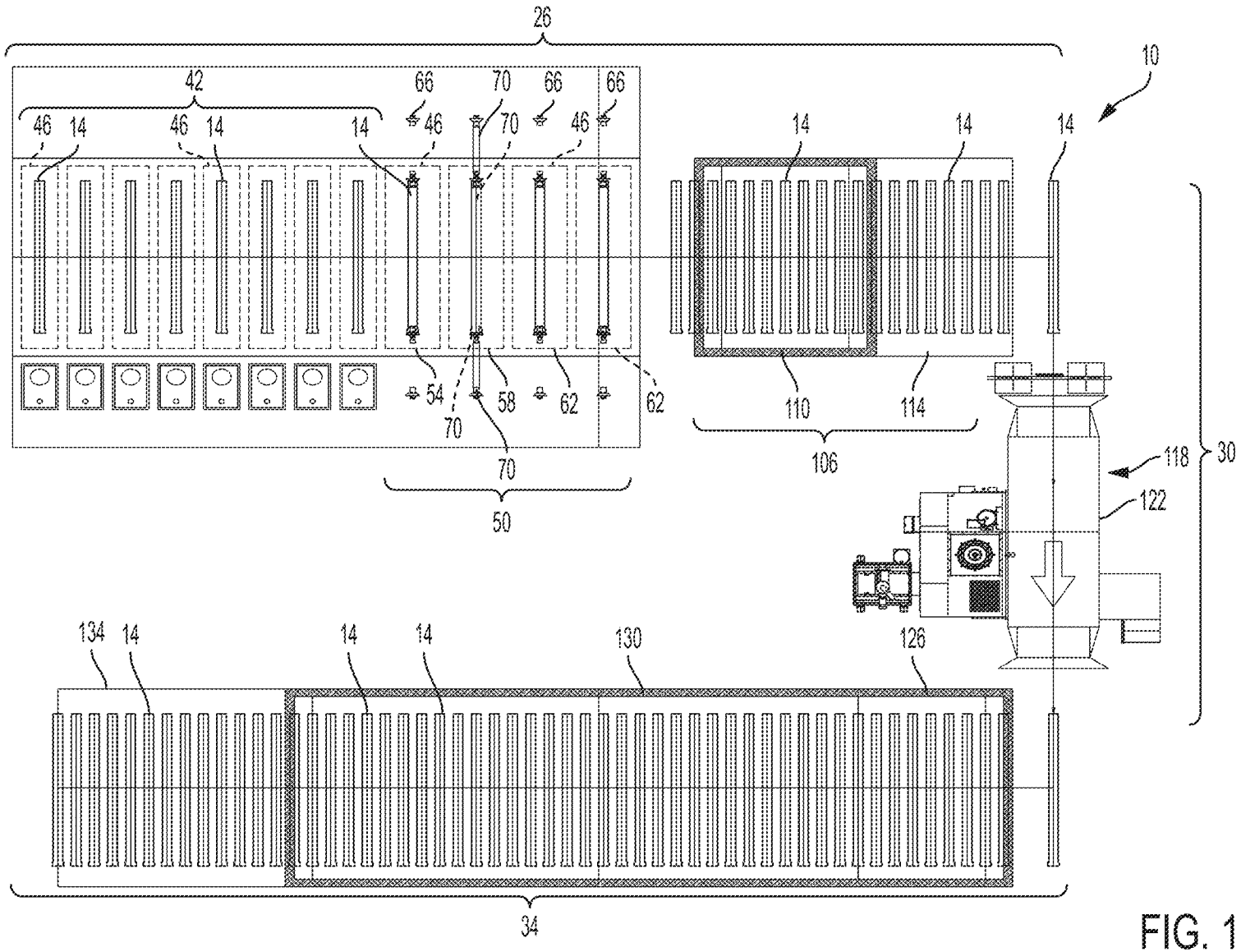
FIG. 1 is a schematic top view of a system and method for coating an internal cavity of a product according to one embodiment of the present disclosure.

FIG. 1 illustrates a system and method 10 of coating a product 14. Specifically, the method includes coating an interior surface 18 defining a cavity 16 of the product 14. An exterior surface 22 of the product 14 may be coated as well, and may be coated using the same or a different method as is used to coat the interior surface 18 of the cavity 16. For example, the interior surface 18 of a pipe 14 can be coated with an e-coat paint using electrophoretic deposition (EPD), and the exterior surface 22 of the pipe 14 can be coated with a dry powder paint, such as acrylic powder. In another embodiment by way of example, both the interior surface 18 and the exterior surface of the product may be coated using a powder paint.

It should be noted that while the below description is made with respect to pipes 14, the method 10 can be used to coat any product 14 having an internal cavity 16 that is difficult or impossible to effectively and economically coat using conventional methods. Likewise, while the below description is made with respect to coating the interior surface 18 of the product with an EPD method, other types of coating applications may be used for the interior surfaces 18. For example, the interior surface 18 of the product 14 may be coated using powder coating, auto deposition, and other product coating systems and methods.

Figure 2:
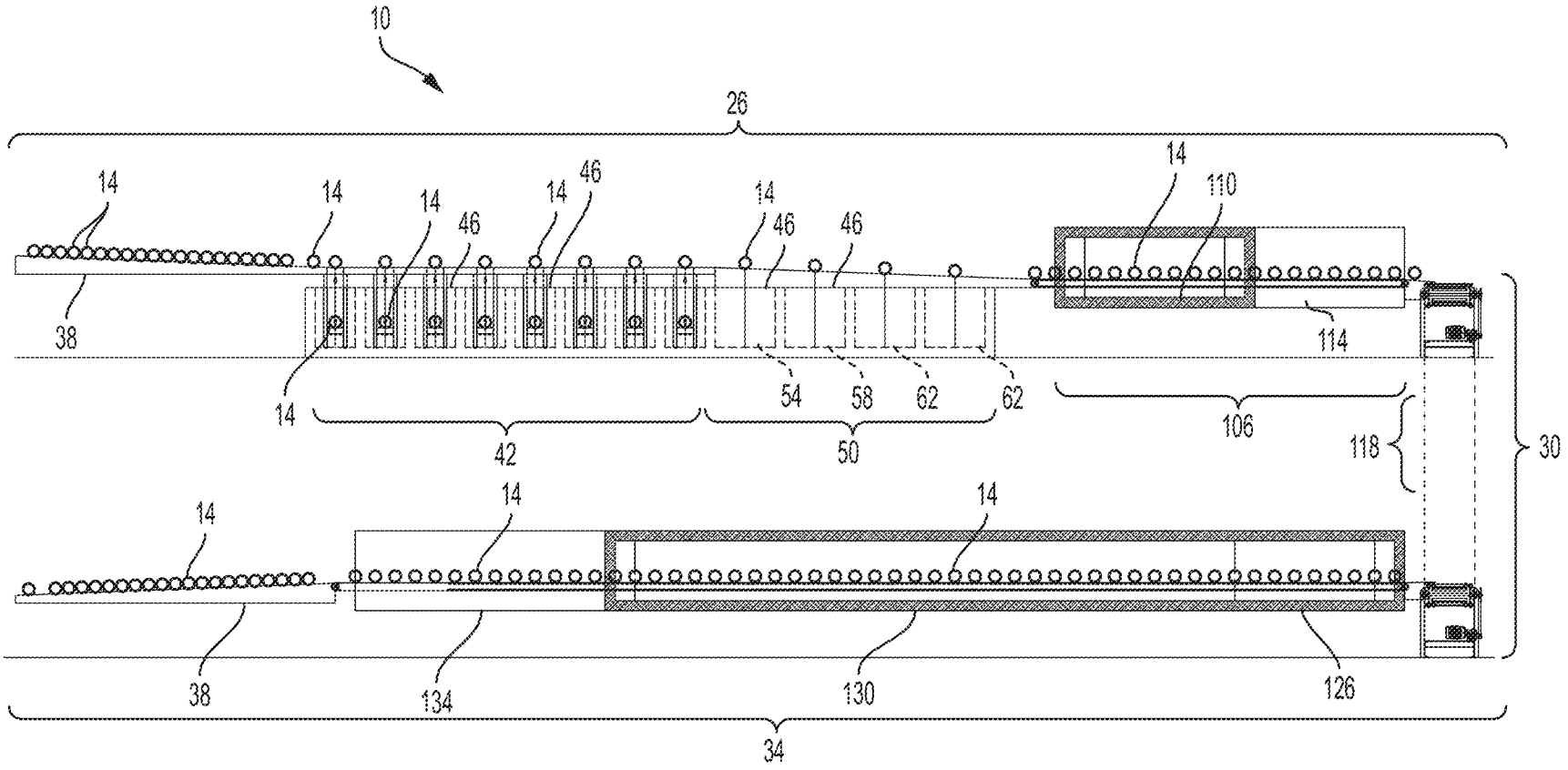
FIG. 2 is a schematic side view of the system of FIG. 1.

With reference to FIGS. 1 and 2, the illustrated system and method 10 involves a three phase process including an internal coating phase 26, an exterior coating phase 30, and a curing phase 34. FIG. 1 illustrates a top view of the three phases 26, 30, 34 of the system 10, and FIG. 2 illustrates a side view of the three phases 26, 30, 34 of the system 10. During the internal coating phase 26, pipes 14 are moved along a load conveyor 38 (from left to right as shown in FIG. 1) and loaded into a pretreatment stage 42. The illustrated conveyor 38 is a chain-on edge conveyor 38 whereby a chain is positioned under each end of the pipes 14. The pipes 14 are rolled onto the chain and thereafter mechanically stopped at each step. In other embodiments, different types of conveyor 38 systems can be used to move the pipes 14 through the system.

Figure 3:
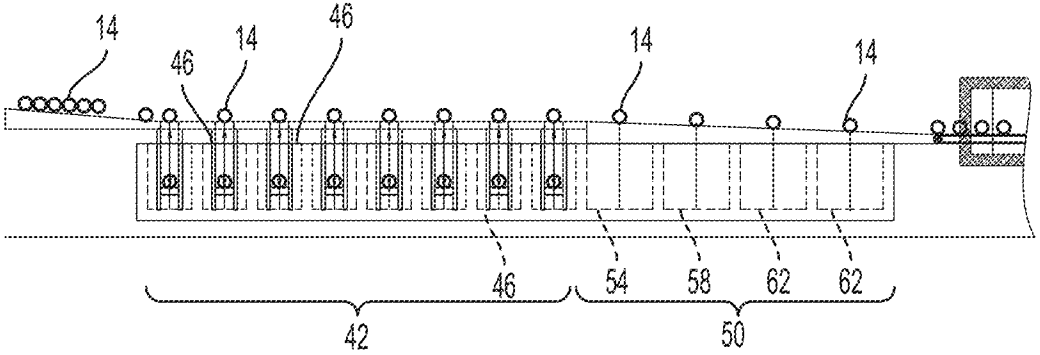
FIG. 3 is a detail view of a portion of the system of FIG. 1.

As shown in FIG. 3, during the pretreatment stage 42, the conveyor 38 moves each pipe 14 through a series of reservoirs 46 containing various pretreatment solutions. Here, the pipes 14 are cleaned and coated with a pretreatment coating. Specifically, each pipe 14 is carried along the conveyor 38 from reservoir 46 to reservoir 46. The conveyor 38 lowers the pipes 14 into each of the reservoirs 46 where the pipes 14 are immersed in each of the pretreatment solutions for a predetermined period. In the illustrated embodiment, the pretreatment stage 42 includes a series of eight reservoirs 46. However, the number and type of reservoirs 46 can vary.

Once the pipes 14 are cleaned and prepared with a pretreatment coating during the pretreatment stage 42, the pipes 14 enter the first treatment stage 50. During the first treatment stage 50 of the illustrated EPD process, the pipes 14 are pre-rinsed (step 54), internally coated (step 58), and post-rinsed (step 62). Depending at least in part upon the type of other product coating processes used as described above, either or both of the pre-rinse and post-rinse steps 54, 62 can be different or can be eliminated, and more pre- or post-coating steps can be added as desired. The conveyor 38 moves the pipes 14 through each of these steps 54, 58, 62. Similar to the pretreatment stage 42, a reservoir 46 is associated with each of these steps 54, 58, 62 in the illustrated embodiment. However, in the illustrated embodiment, the conveyor 38 moves the pipes 14 from reservoir 46 without lowering the pipes 14 into each reservoir 46. The reservoirs 46 are used to catch excess solution that falls during the steps 54, 58, 62 described herein.

In the illustrated embodiment, a reverse osmosis rinse is used as the pre-rinse 54. In other embodiments, other types of rinses can be used as a pre-rinse 54. A sealing device 66 can be used to seal the interior 18 of the pipe 14 during the pre-rinse 54. Once the pipes 14 are pre-rinsed, the interior 18 of the pipes 14 are coated using a type of electrophoretic deposition in the illustrated embodiment.

With reference to FIGS. 4-7, the internal coating is applied using one or more applicators 70. In the illustrated embodiment, an applicator 70 is inserted into each end of the pipe 14. Specifically, the applicators 70 are each inserted through an opening 68 that extends between the interior surface 18 and the exterior surface 22 of the pipe 14. In other embodiments, a single applicator 70 may be used to apply the coating material. In the illustrated embodiment, the applicator 70 is primarily made of a metal, such as steel, and has an elongated body 86 (see FIG. 7). The elongated body 86 can have a cylindrical shape as shown in the illustrated embodiment, with a first end 90 and a second end 94. The first end 90 of the illustrated body 86 is tapered to form a pointed end. The diameter of the actuator 70 is less than the diameter of the pipe 14 such that it can be inserted into the pipe 14. In the illustrated embodiment, the applicators 70 each include an electrode 74 to apply coating material to the interior surface 18 of the pipe 14 using an EPD method. In other embodiments, different types of applicators 70 may be used to apply coating material depending on the type of coating process used. For example, the applicator may include a spray or misting head.

Figure 4A:
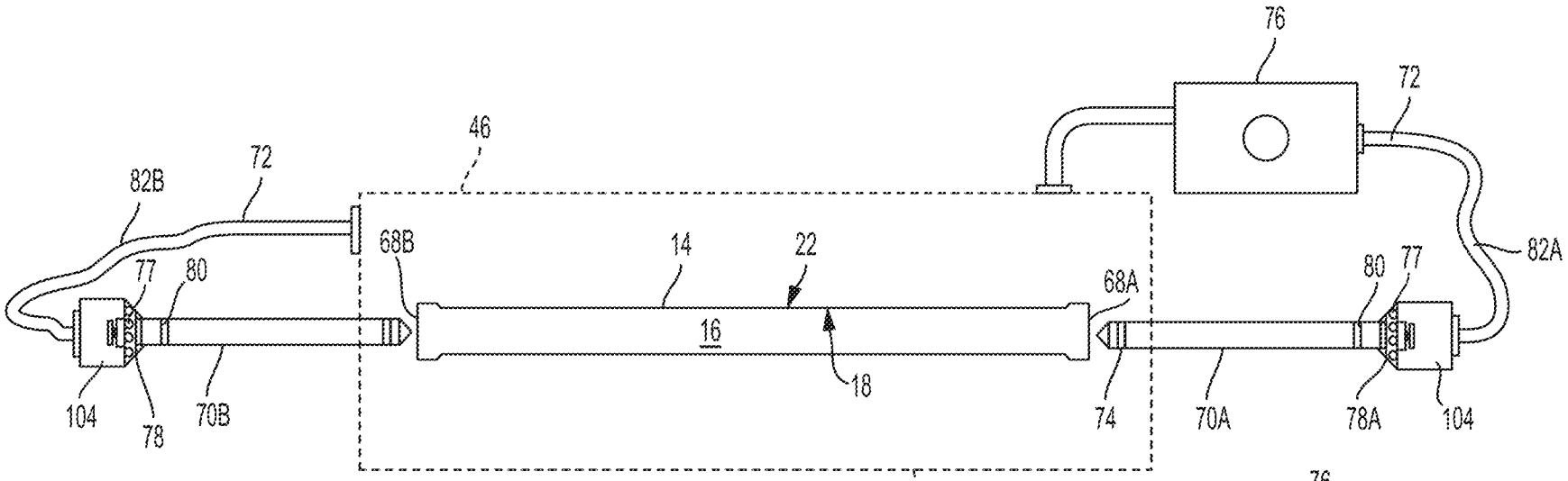
FIG. 4A is a schematic plan view of applicators and plugs in one position relative to a product.
Figure 4B:
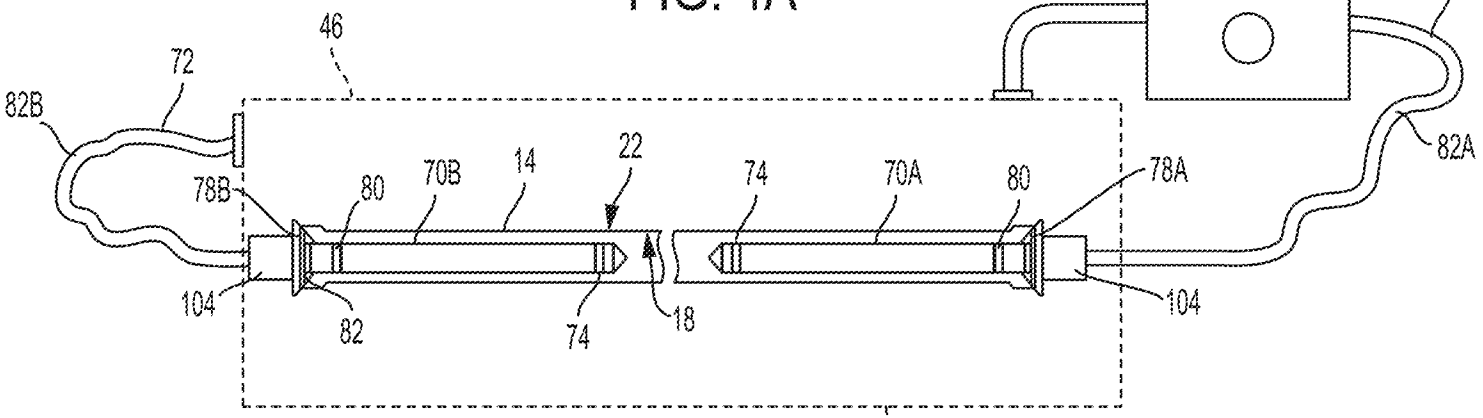
FIG. 4B is a schematic plan view of the applicators and plugs of FIG. 4A in another position relative to the product, with the product shown sectioned.
Figure 5A:
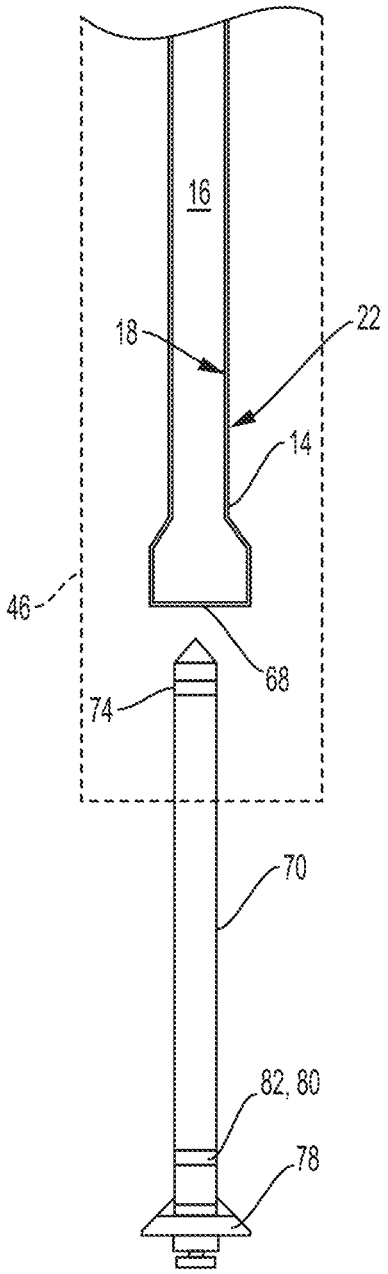
FIG. 5A is a detail view of an applicator and a plug in one position relative to a product, with the product shown sectioned.
Figure 5B:
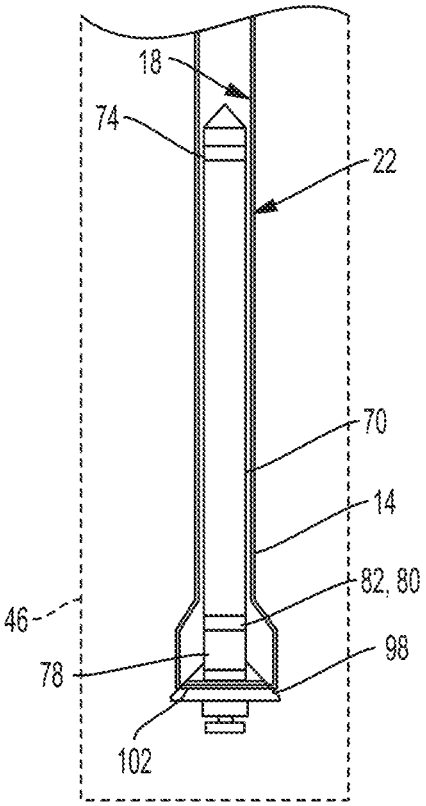
FIG. 5B is a detail view of the applicator and plug of FIG. 5A in another position relative to the product, with the product shown sectioned.
Figure 7:
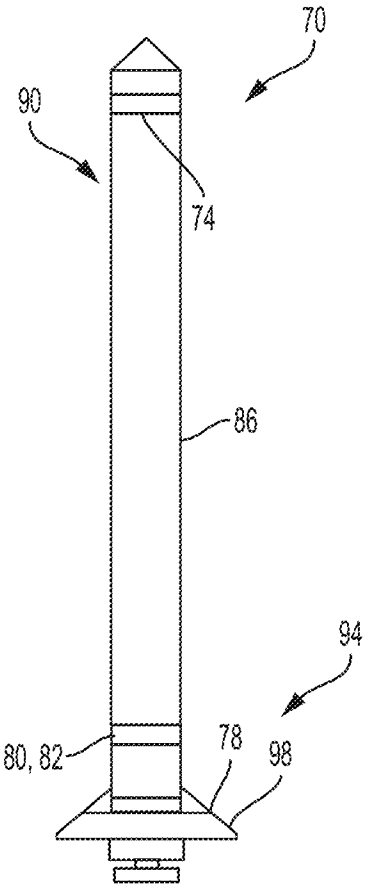
FIG. 7 is a schematic illustration of an applicator and a plug.

With combined reference to FIGS. 5A, 5B and 7, the second end 94 of the applicator 70 extends from a plug 78 that is used to seal the opening 68 of the pipe 14. Prior to coating the internal surface 18 of the pipe 14, the plug 78 closes the opening 68, and in some cases seals the opening 68 in a liquid-tight or air-tight manner. In the illustrated embodiment, and as shown in FIGS. 4A and 4B, a plug 78 is inserted into the opening 68 on each end of the pipe 14 to seal the cavity 16 of the pipe 14 during the coating process. In other embodiments, only one plug 78 is used, leaving one of the openings 68 open during the coating process. In other embodiments, the product 14 may have only one opening 68, in which case a single plug 78 can be used.

Figure 6B:
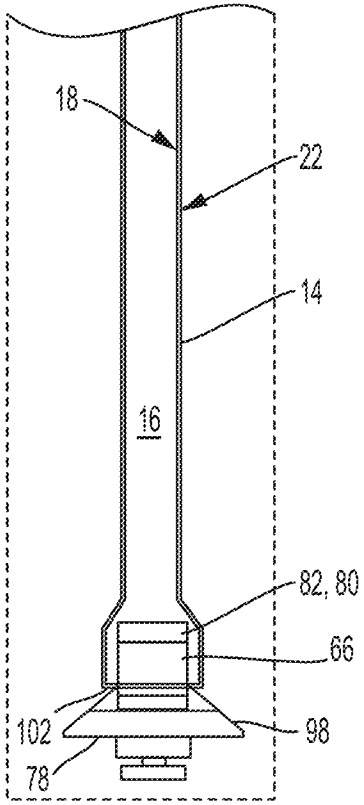
FIG. 6B is a detail view of the plug of FIG. 6A in another position to seal the product, with the product shown sectioned.
Figure 6A:
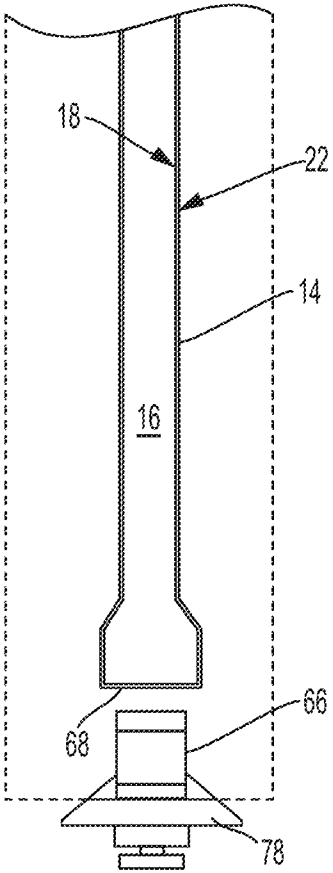
FIG. 6A is a detail view of a plug in a position relative to a product, with the product shown sectioned.
Figure 8:
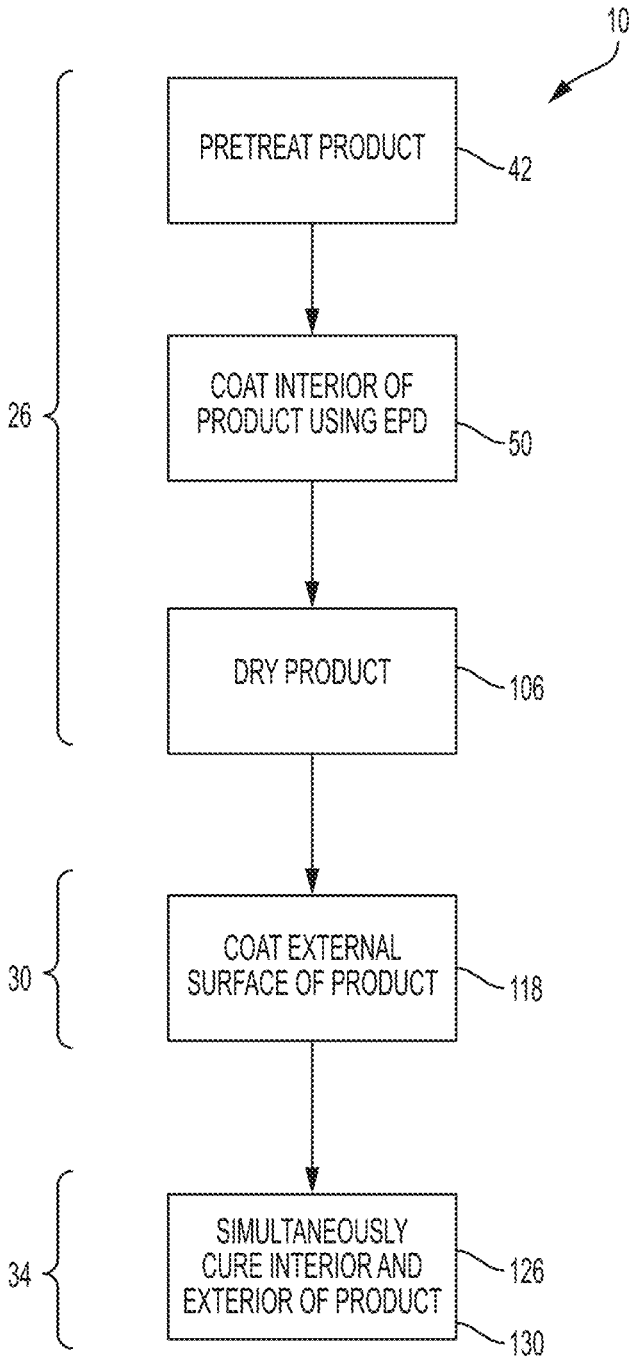
FIG. 8 is a flowchart of a method according to the present disclosure.
Figure 9:
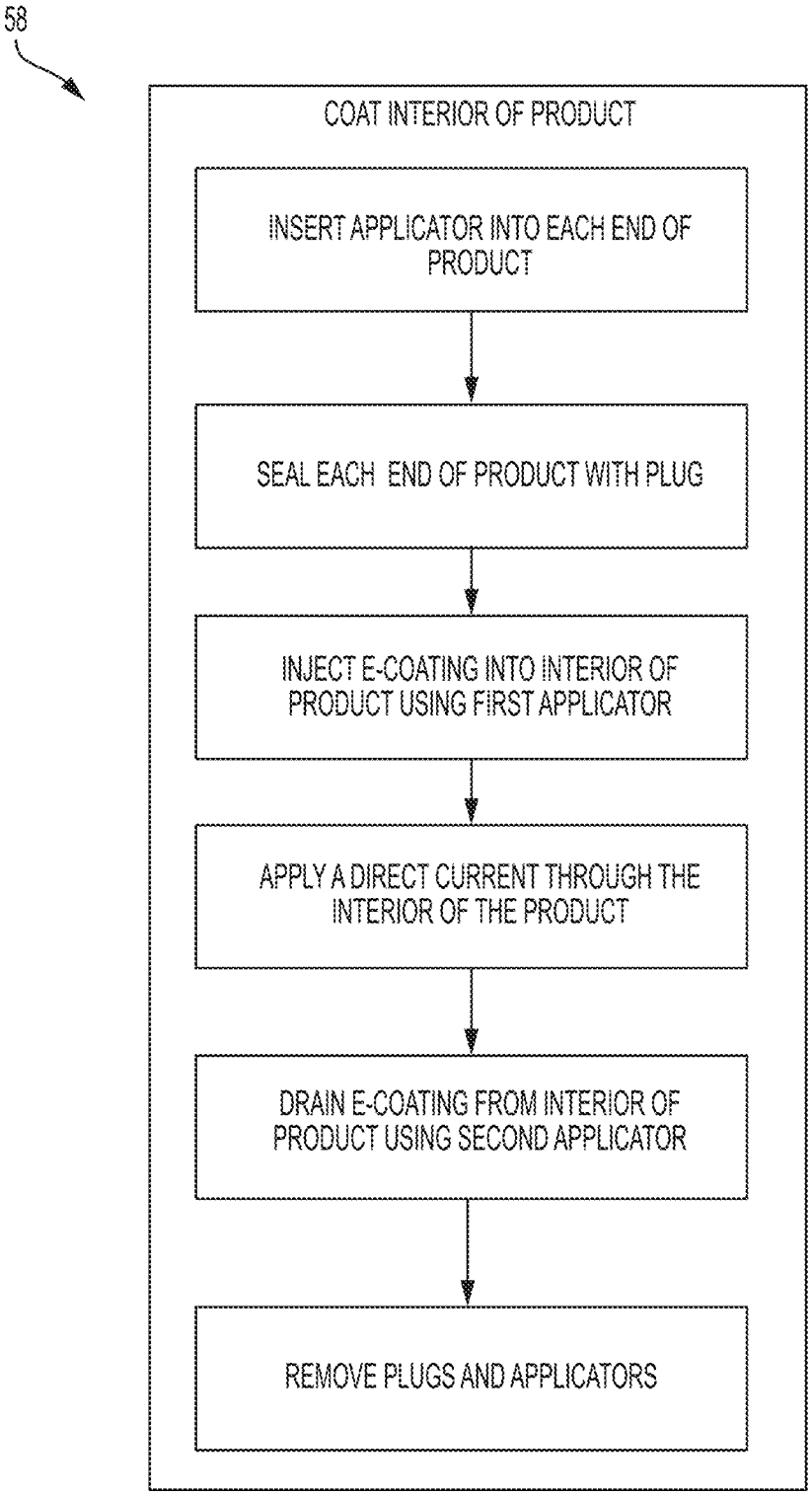
FIG. 9 is a flowchart of another method according to the present disclosure.

As shown in FIGS. 6A-C, in some embodiments the plug 78 is flared to form a conical projection 98. The diameter of the largest portion of the conical projection 98 is greater than the diameter of the pipe 14, and is used to prohibit the applicator 70 from being inserted further into the pipe 14 after the plug 78 has been brought into contact with the pipe 14. When the applicator 70 is inserted into the pipe 14, the conical projection 98 engages with an edge 102 of the opening 68 to close (and in some cases, seal) the opening 68 and prevent the applicator 70 from being inserted further into the pipe 14. In addition, the plug 78 can be shaped to maintain the position of the applicator 70 in an orientation that is parallel to the pipe 14, such as the conical shape of the plug as shown in the illustrated embodiment. This can ensure that the applicator 70 does not contact or engage the interior 18 of the pipe 14. In other embodiments, the plug 78 may have different shapes and sizes that are sufficient to close, and in some cases seal, the opening 68.

In some embodiments, the plug 78 is coated with a rubberized or otherwise elastomeric material. The elastomeric material on the plug 78 softens the engagement of the plug 78 and the pipe 14, and helps to seal the end of the pipe 14. In some embodiments, the pipe 14 is only engaged with the applicator 70 on the rubberized surface of the plug 78, and does not engage directly with a metal surface of the applicator 70.

With reference now to FIGS. 4A and 4B, in the illustrated embodiment an actuator 104 (not shown) is actuatable to move the plug 78 between a first position in which the plug 78 is retracted from the pipe 14 and in which the applicator 70 is withdrawn therefrom, and a second position in which the plug 78 is engaged with the pipe 14 to selectively seal the cavity 16 and in which the applicator 70 is received within the pipe 14. In the second position (FIGS. 4B, 5B, and 6B), the plug 78 engages the opening 68 and seals the cavity 16. Specifically, the conical projection 98 of the plug 78 engages with the edge 102 of the opening 68, as shown in FIGS. 5B and 6B. In addition, when the plug 78 is in the second position, the applicator 70 extends into the cavity 16 in order to coat the interior surface 18 of the cavity 16. In the first position (FIGS. 4A, 5A, and 6A), the plug 78 is disengaged from the opening 68 and the cavity 16 is no longer sealed. In addition, the applicator 70 is removed from the cavity 16 in the first position.

Accordingly, prior to coating the pipes 14, the actuator 104 moves the plug 78 into the second position to seal the opening 68 of the cavity 16. Once the pipe 14 is sealed off by the plugs 78, the applicators 70 are used to distribute coating material into the cavity 16 of the pipe 14. The coating material is guided into and removed from the cavity 16 of the pipe 14 through one or more ports 77 in each plug 78 (shown only in FIGS. 4A and 4B). The ports 77 of each plug 78 are in fluid communication with an internal chamber or manifold (not shown) at the base of each plug 78, which is itself in fluid communication with a fluid line 72 as shown in FIGS. 4A and 4B. In this manner, a fluid passageway leading to the port(s) 77 is defined through the plug 78 through which coating fluid can be introduced into the pipe 14 and through which coating fluid can be removed from the pipe 14.

With continued reference to FIGS. 4A and 4B of the illustrated embodiment, coating fluid is supplied to the internal cavity 16 of the pipe 14 through the ports 77 of the plug 78 at the right side of FIGS. 4A and 4B, exits the internal cavity 16 via ports 77 of the plug 78 at the left side of FIGS. 4A and 4B, is received in the reservoir 46 (which can be a tank or other structure capable of holding an amount of the coating fluid, such as in a location beneath the pipe 14 as shown in FIGS. 4A and 4B), is drawn from the reservoir 46 by a pump 76 that delivers the fluid via the fluid line 72 back to the plug 78 at the right side of FIGS. 4A and 4B, and again enters the cavity 16 of the pipe 14 via the ports 77 of the plug 78 on the right side of FIGS. 4A and 4B. In those embodiments in which the reservoir 46 is located beneath the pipe 14, such as in the illustrated embodiment, any coating fluid that escapes the pipe 14 or plugs 78 can simply fall to the reservoir 46 to re-enter the fluid cycle just described. Also, although the pump 76 of the illustrated embodiment is described as being downstream of the reservoir 46, in other embodiments the flow of coating fluid can be reversed so that coating fluid enters the pump 76, is supplied to the reservoir 46 and then to the plug 76 on the left side of FIGS. 4A and 4B, and exits the pipe 14 via the plug 76 on the right side of FIGS. 4A and 4B. In these and other embodiments, the pump 76, reservoir 46, and fluid lines 72 can all be plumbed in a closed fluid system allowing fluid to be forced to the plug 78 at the left side of FIGS. 4A and 4B. Also, in some embodiments the reservoir 46 is not used. In embodiments in which a reservoir 46 is used, any type of reservoir (e.g., closed or open tank, well, accumulator, and the like) can be used as desired.

Although in the illustrated embodiment coating fluid enters and exits the internal cavity 16 of the pipe 14 via ports 77 in the plugs 78 as described above, in other embodiments the applicator 70 is in fluid communication with an internal chamber or manifold at the base of each plug 78 or applicator 70, and can be provided with one or more internal passages extending axially along any portion or all of the length of the applicator 70 to one or more exit ports positioned at any desired location(s) along the applicator 70. By way of example only, an alternative fluid exit or entry location in the illustrated embodiment is one or more (e.g., ring) of exit ports 82 on the body of the applicator 70, in which case ports 77 in the plugs 78 need not exist. In the illustrated embodiment, the applicator 70 and the plug 78 are defined as a single integral unit. However, in other embodiments, the applicator 70 and the plug 78 are separable pieces.

In some embodiments, fewer or greater numbers of plugs 78 or fluid passageways may be used. For example, a single plug 78 may include two passageways and respective ports 77. In such embodiments, one passageway and port 77 may be used to inject coating fluid into the cavity 16, whereas the other passageway and port 77 may be used to remove the coating fluid from the cavity 16. In other embodiments, the same passageway and port(s) 77 may be used to both inject and remove coating fluid into and out of the cavity 16.

As described above, in the illustrated embodiment the pump 76 pumps coating fluid from the reservoir 46 to the end of the pipe 14 on the right side of FIGS. 4A and 4B via fluid line 72, and into the internal cavity 16 of the pipe 14 via the ports 77 of the plug 78. In some embodiments, the coating fluid fills the internal cavity of 16 of the pipe 14. The pipe 14 can be oriented at a slight upward angle so that that coating material must travel uphill to fill the pipe 14. In other words, one end of the pipe 14 is gravitationally higher than the other end. The upward angle of the pipe 14 reduces the number of bubbles in the pipe as the coating material is injected into the pipe 14, and can allow bubbles that do form to dissipate more readily.

With the pipe 14 filled with coating fluid, the applicator 70 is used to apply the coating material to the interior surface 18 of the cavity 16. In the illustrated embodiment, electrical current is driven through the pipe 14 in an EPD process. Specifically, the applicator 70 includes an electrode 74, which is used as either an anode or a cathode to help conduct electrical current through the pipe 14 during the EPD process. The electric current is driven through the pipe 14, from one applicator 70 to another. The applicators 70 act as counter-electrodes 74, and the pipe 14 acts as an electrode 74. The pipe 14 can either be used as a cathode or an anode depending on whether an anode EPD method is used or a cathode EPD method is used. Driving electrical current through the pipe 14 causes the e-coating to attach to the interior surface 18 of the pipe 14.

After the coating process is complete, the actuators 104 retract the plugs 78 into the respective first positions so that the plugs 78 are disengaged from the openings 68 and the applicators 70 are removed from the cavity 16. The pipe 14 is drained of the coating fluid via the fluid line 72 on the left side of FIGS. 4A and 4B and/or by retraction of either or both plugs 77 from the pipe 14 via the actuators 104 as described above. The drained coating fluid then collects in the reservoir 46, and can be re-used by being drawn by the pump 76 as described above. In other embodiments, the drained coating is instead discharged to waste.

As described above, other surface coating methods (other than EPD coating) can be used to coat the interior surface 18 of the cavities 16 of the pipes 14. In such alternative embodiments, the plugs 78 and/or applicators 70 can have different shapes and sizes. By way of example only, in some embodiments the applicator delivers a spray of powder to the interior of the pipes 14, in which case the powder can be discharged from a plurality of spray ports along the length and circumference of the applicators 70. As other examples, in some types of coating systems coating fluid (e.g., as a liquid or powder) is introduced into the pipe 14 through the plugs 78 without the use of applicators 70. In such cases, the plugs 78 can appear as shown in FIG. 6A, which can be the same as those plugs 78 used in the pre-rinse and post-rinse steps 54, 62 described above.

After being coated as described above, the pipe 14 is moved to the post-rinse process 62. In the illustrated embodiment, each pipe 14 goes through two post-rinse processes 62. However, in other embodiments, only a single post-rinse process 62 is used. The post-rinse process 62 marks the end of the first treatment stage 50.

The conveyor 38 moves the pipes 14 from the first treatment stage 50 to a drying stage 106, where the pipes 14 are dehydrated (step 110) for a predetermined period and then cooled (step 114) for a predetermined period. In the illustrated embodiment, the dehydration period 110 lasts for approximately 14 minutes and the cooling 114 period lasts for approximately 14 minutes. The drying stage 106 partially dries the interior 18 coating of the pipes 14, but does not fully cure the interior 18 coating. The drying stage 106 is the last stage of the interior coating phase 26.

The pipes 14 move from the interior coating phase 26 to the exterior coating phase 30. In some embodiments, the pipes 14 are moved from one conveyor 38 to another conveyor 38 between these phases 26, 30. During the exterior coating phase 30, the pipes undergo a second treatment stage 118. During the second treatment stage 118, the exterior surfaces 22 of the pipes 14 are powered coated. The pipes 14 are moved through a powder coating machine 122 where power coating is misted onto the exterior surface 22 of the pipes 14 until the coating becomes thick. In other embodiments, the exterior surface 22 of the pipes 14 is coated in other manners, such as by electrophoretic deposition, auto deposition, powder coating, and painting, by way of example only.

Following the exterior coating phase 30, the pipes 14 are moved to the curing phase 34 where both the interior coating and exterior coating are cured to the pipe 14. The curing phase 34 consists of several stages of heating and cooling. During the first curing stage 126, the pipes 14 are heated in a melt zone oven for a short period of time at a relatively lower temperature. For example, the pipes 14 are heated for approximately 14 minutes at 300 degrees Fahrenheit. During the second curing stage 130, the pipes 14 are heated in a melt zone oven for a relatively longer period of time at a higher temperature. For example, the pipes 14 are heated for approximately 60 minutes at 400 degrees. Finally, the pipes 14 enter the third stage of curing 134 where the pipes 14 are cooled and unloaded by an unload conveyor 38. In one embodiment, the pipes 14 are cooled for approximately 24 minutes.

Although the invention has been described with reference to certain preferred embodiments, variations and modifications exit within the spirit and scope of the present invention.

What is claimed is:

1. A product coating system for coating a product with a coating material, the product including an exterior surface, a cavity defined by an interior surface, and an opening extending between the exterior surface and the interior surface, the product coating system comprising:

a plug sized and shaped to selectively close the opening, the plug movable relative to the opening between a first position in which the plug is retracted from the opening, and a second position in which the plug is engaged with the opening to close the opening and to retain the coating material within the cavity;

a port defined in the plug and through which the coating material passes to enter the cavity;

a pump; and a fluid line establishing fluid communication between the pump and the port;

the system having a first configuration in which the plug is in the first position and delivery of the coating material to the cavity is stopped, and a second configuration in which the plug is in the second position and in which the pump delivers the coating material to the cavity of the product via the fluid line and port.

2. The product coating system of claim 1, wherein the plug establishes a liquid-tight seal with respect to the product when the plug is in the second position.

3. The product coating system of claim 1, wherein the fluid line is a first fluid line, the product coating system further comprising a second fluid line extending between the product and the pump, the second fluid line delivering the coating material from the product toward the pump in the second configuration of the system.

4. The product coating system of claim 3, wherein the second fluid line extends to a fluid reservoir in fluid communication with the pump and from which the pump draws the coating material.

5. The product coating system of claim 1, wherein the plug is a first plug, the opening is a first opening, and the port is a first port, the product coating system further comprising:

a second plug sized and shaped to selectively close a second opening of the product; and a second port defined in the second plug and through which the coating material passes to exit the cavity.

6. The product coating system of claim 5, wherein the fluid line is a first fluid line, the product coating system further comprising a second fluid line extending between the product and the pump, the second fluid line delivering the coating material from the product toward the pump in the second configuration of the system.

7. The product coating system of claim 1, further comprising an actuator coupled to the plug, the plug movable by the actuator between the first and second positions.

8. The product coating system of claim 1, wherein the plug includes an annular flange that engages with an edge of the opening when the plug is in the second position, the annular flange having a diameter that is greater than a diameter of the opening of the product.

9. The product coating system of claim 1, wherein the plug is coated with an elastomeric material to help seal the opening of the product when the plug is in the second position.

10. The product coating system of claim 1, further comprising an applicator extending from the plug, the applicator received within the cavity of the product when the plug is in the second position, and retracted from the cavity when the plug is in the first position, wherein the applicator is one of an electrode and a powder coating sprayer.

11. The product coating system of claim 10, wherein when in the second position of the plug, the plug maintains an orientation of the applicator in which the applicator does not engage with the interior surface of the cavity.

12. A product coating system for coating an interior surface of a cavity of a product with a coating liquid, the product including an exterior surface, a first opening extending between the exterior surface and the interior surface, and a second opening extending between the exterior surface and the interior surface, the product coating system comprising:

first and second plugs sized and shaped to selectively seal the first and second openings, respectively, each of the first and second plugs movable relative to the respective first and second openings between respective first positions in which the first and second plugs are retracted from the first and second openings, and respective second positions in which the first and second plugs seal the first and second openings;

a pump;

a first fluid line extending between the pump and the first plug for directing the coating liquid from the pump toward the first plug;

a second fluid line extending from the second plug for directing the coating liquid from the second plug back to the pump; and an electrode removably insertable into the cavity of the product to a position in which the electrode is inside the cavity and out of contact with the interior surface of the cavity while the first and second plugs are in the respective second positions;

wherein the coating liquid pumped to the first plug enters the cavity through the first plug and fills the cavity; and wherein the coating liquid is drained from the cavity through the second plug and into the second fluid line.

13. The product coating system of claim 12, further comprising a reservoir in fluid communication with the pump such that the pump is configured to draw the coating liquid from the reservoir, wherein the second fluid line is connected to the reservoir to supply the coating liquid back to the pump through the reservoir.

14. A product coating system for coating a product with a coating material, the product including an exterior surface, a cavity defined by an interior surface, and an opening extending between the exterior surface and the interior surface, the product coating system comprising:

a plug sized and shaped to selectively close the opening, the plug movable relative to the opening between a first position in which the plug is retracted from the opening, and a second position in which the plug is engaged with the opening to close the opening and to retain the coating material within the cavity;

at least one port through which the coating material is delivered to the interior surface of the product;

a pump; and a fluid line establishing fluid communication between the pump and the at least one port;

the system having a first configuration in which the plug is in the first position and the coating material delivery to the cavity is stopped, and a second configuration in which the plug is in the second position and in which the pump delivers the coating material to the cavity of the product via the fluid line and the at least one port.

15. The product coating system of claim 14, wherein the at least one port is provided in an applicator that extends into the cavity from the plug.

16. The product coating system of claim 15, wherein the applicator further includes an electrode.

17. The product coating system of claim 16, wherein the product coating system is an electrophoretic deposition coating system and the electrode is configured as either an anode or a cathode to conduct electrical current through the product.

18. The product coating system of claim 14, wherein the plug is a first plug, the product coating system further comprising a second plug sized and shaped to selectively close an additional opening in the product, the second plug movable relative to the additional opening between a first position in which the second plug is retracted from the additional opening, and a second position in which the second plug is engaged with the additional opening to close the additional opening.

19. The product coating system of claim 18, further comprising a first electrode supported by the first plug to extend into the cavity in spaced relationship with the interior surface, and a second electrode supported by the second plug to extend into the cavity in spaced relationship with the interior surface.

20. The product coating system of claim 19, wherein the first electrode is provided on a first applicator having a port, and the second electrode is provided on a second applicator having a port, wherein the coating material is supplied into and out of the cavity through the ports of the respective first and second applicators.

21. The product coating system of claim 20, wherein each of the first and second applicators includes a plurality of spray ports along the length and circumference thereof.

* * * * *